US006592209B2

(12) United States Patent
Miyamoto et al.

(10) Patent No.: US 6,592,209 B2
(45) Date of Patent: Jul. 15, 2003

(54) PRINTER, PRINTER HEAD, AND METHOD OF PRODUCING THE PRINTER HEAD

(75) Inventors: Takaaki Miyamoto, Kanagawa (JP); Minoru Kohno, Tokyo (JP); Toru Tanikawa, Kanagawa (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 10/053,412

(22) Filed: Nov. 7, 2001

(65) Prior Publication Data

US 2002/0126181 A1 Sep. 12, 2002

(30) Foreign Application Priority Data

Nov. 7, 2000 (JP) ..... 2000-344233

(51) Int. Cl.[7] ..... B41J 2/05
(52) U.S. Cl. ..... 347/63
(58) Field of Search ..... 347/63, 64, 65, 347/67, 44, 47, 56, 61, 57–59; 29/890.1, 611

(56) References Cited

U.S. PATENT DOCUMENTS

| | | | | |
|---|---|---|---|---|
| 5,194,877 A | * | 3/1993 | Lam et al. | 347/63 |
| 5,450,108 A | | 9/1995 | Drake et al. | 347/65 |
| 5,534,901 A | | 7/1996 | Drake | 347/63 |
| 6,063,702 A | | 5/2000 | Chung | 438/624 |

* cited by examiner

*Primary Examiner*—Thinh Nguyen
*Assistant Examiner*—Juanita Stephens
(74) *Attorney, Agent, or Firm*—Sonnenschein, Nath & Rosenthal

(57) ABSTRACT

The invention provides a printer, a printer head, and a method of producing the printer head. In particular, the invention is applied to a printer which makes use of a process in which ink drops are caused to flow out by heating using a heater, so that an orifice plate can be bonded by sufficiently bringing it into close contact with what it is to be bonded to. In the invention, by disposing first, second, and third wiring patterns below partitions of corresponding ink chambers, thickness-direction stepped portions are prevented from being formed at least at the partitions of the corresponding ink chambers.

17 Claims, 8 Drawing Sheets

PRINTER, PRINTER HEAD, AND METHOD OF PRODUCING THE PRINTER HEAD

RELATED APPLICATION DATA

The present application claims priority to Japanese Application(s) No(s). P2000-344233 filed Nov. 7, 2000, which application(s) is/are incorporated herein by reference to the extent permitted by law.

BACKGROUND OF THE INVENTION

1. Field of the Invention

The present invention relates to a printer, a printer head, and a method of producing the printer head. In particular, the present invention is applicable to a printer which makes use of a process of which causes ink droplets to fly out as a result of heating by a heater. The present invention makes it possible to, by preventing a thickness-direction stepped portion from being formed at least at a partition of an ink chamber as a result of disposing a wiring pattern below the partition of the ink chamber, bring an orifice plate sufficiently into close contact with what it is to be bonded to and bond it thereto.

2. Description of the Related Art

In recent years, in the field of image processing and the like, there has been an increasing need for color hard copies. To respond to this need, there has been conventionally proposed a sublimation thermal transfer process, a fusion thermal transfer process, an inkjet process, an electrophotographic process, a thermally processed silver process, and the like.

In the inkjet process, a dot is formed by causing small drops of recording liquid (ink) to fly out from a nozzle of a recording head and causing them to adhere to what is to be subjected to a recording operation. This makes it possible to output a high-quality image using a simple structure. The inkjet process is classified into, for example, an electrostatic attraction process, a continuous vibration generation process (piezo process), and a thermal process, depending on the method used to cause the ink to fly out.

In the thermal process, air bubbles are produced by heating localized portions of the ink in order to push out the ink from a discharge opening by the air bubbles, thereby causing the ink to fly out to what is to be subjected to printing. This makes it possible to print a color image using a simple structure.

A printer which operates by this thermal process is constructed using what is called a printer head, which has mounted therein a heating element which heats ink, a drive circuit based on a logic integrated circuit which drives the heating element, and other component parts.

FIG. 8 is a sectional view partly showing a thermal head of the prior art. In forming a printer head 1, an isolation area 3 (LOGOS: local oxidation of silicon) which isolates transistors is formed on a P-type silicon substrate 2, and, for example, a gate oxide film is forced at a transistor formation area remaining between portions of the isolation area 3, thereby forming MOS (metal oxide semiconductor) switching transistors 4 and MOS transistors 5 and 6 forming a drive circuit.

Next, in forming the printer head 1, after placing, for example, an insulating film, a contact hole is formed in order to form a first-layer wiring pattern 7. By the first-layer wiring pattern 7, the MOS transistors 5 and 6, forming the drive circuit, are connected to each other, thereby forming a logic integrated circuit.

Next, in forming the printer head 1, after, for example, the insulating film has been placed, sputtering is carried out in order to deposit heating element materials, such as tantalum, tantalum aluminum, or titanium nitride, in order to form resistance films in localized portions. By the resistance films, heating elements 8 which heat ink are formed.

Next, in forming the printer head 1, a contact hole is formed to form a second-layer wiring pattern 9. By the second-layer wiring pattern 9, a connection portion between the switching transistors 4 and the heating elements 8, a connection portion between the heating elements 8 and a power supply, a ground line, and the like, are formed.

Next, in forming the printer head 1, an insulating material, such as $SiO_2$ or SiN, is deposited in order to form a protective layer 10, after which a Ta film is formed on localized portions of the heating elements 8. By the Ta film, a cavitation resistance layer 11 is formed. Next, a dry film 13 and an orifice plate 14 are successively placed upon each other. Here, the dry film 13 is formed of, for example, carbon resin. After placing it by contact bonding, portions thereof situated in correspondence with an ink chamber and an ink path are removed, after which a hardening operation is carried out. On the other hand, the orifice plate 14 is formed of a plate-shaped material which is processed into a predetermined shape so that a nozzle 15, which is a very small ink discharge opening, is formed above the heating elements 8. The orifice plate 14 is supported on the top portion of the dry film 13 as a result of adhering it thereto. When the above-described operations are carried out, the nozzle 15, an ink chamber 16, a path for guiding ink into the ink chamber 16, etc., are formed at the printer head 1.

In the printer head 1, the ink is guided to the ink chamber 16, and, by a switching operation of the switching transistors 4, the heating elements 8 generate heat in order to heat localized portions of the ink. By the heating, core air bubbles are produced at side surfaces of the heating elements 8 of the ink chamber 16. These core air bubbles combine to form film air bubbles. When pressure is increased by the air bubbles, the ink is pushed out from the nozzle 15 and flies out to what is to be subjected to printing. As a result, in a printer using the printing head 1, intermittent heating by the heating elements 8 causes the ink to successively adhere to what is to be subjected to printing, so that a desired image is formed.

Further, in the printer head 1, the switching transistors 4, which drive the heating elements 8 are controlled by the same logic integrated circuit formed by the MOS transistors 5 and 6. Therefore, the heating elements 7 are disposed very closely together, thereby making it possible to reliably drive them by their corresponding switching transistors 5, 6.

In other words, in order to obtain a high-quality printed result, the heating elements 8 need to be disposed very close to each other. More specifically, in order to obtain, for example, a 600 DPI printed result, the heating elements 8 need to be disposed at intervals of 42,333 $\mu$m. It is extremely difficult to dispose individual drive elements at the heating elements 8 disposed very close to each other. Therefore, in the printer head 1, for example, switching transistors are formed on the semiconductor substrate and are connected to the corresponding heating elements 8 by an integrated circuit technology. Then, by the drive circuits similarly formed on the semiconductor substrate, the corresponding switching transistors are driven in order to make it possible to simply and reliably drive each of the heating elements 8.

However, the printer head 1 having such a structure has a problem in that it is difficult to bring the orifice plate 14 sufficiently into close contact with the dry film 13 and to bond it thereto.

More specifically, in a commonly used semiconductor integrated circuit, the first-layer wiring pattern 7 is formed with the minimum thickness required, and the second-layer wiring pattern 9, which forms a power supply line and a ground line, is made thick in order to obtain a desired current capacity.

In contrast to this, in the printer head 1, the situation is reversed with respect to the case of the commonly used semiconductor integrated circuit, so that the first-layer wiring pattern 7 is made thick, whereas the second-layer wiring pattern 9 is made thin, in order to obtain good covering property at the silicon nitride film forming the ink protective layer 10 and the tantalum cavitation resistance layer 11, which are formed above the heating elements 8.

In the printer heat 1, by virtue of such a structure, the second-layer wiring pattern 9 is formed with a thickness of the order of 1 $\mu$m when an aluminum wiring pattern is used, and a stepped portion having a size of the order of 1 $\mu$m is formed at the second-layer wiring pattern 9. In this way, when the stepped portion having a size of the order of 1 $\mu$m is formed at the second-layer wiring pattern 9, very fine recesses and protrusions are formed at the surface of the protective layer 10, which is formed on top of the wiring patter 9, and the surface of the dry film 13. Because of the very fine recesses and protrusions, it becomes difficult to bring the orifice plate 14 sufficiently into close contact with the dry film 13 and to bond it thereto. In this connection, when the surfaces of the protective layer 10 and the dry film 13 become very uneven, ink leakage may occur.

FIG. 9A is a plan view of the printer head 1 in FIG. 8 in which the dry film 13 has been removed, and FIG. 9B is a sectional view of the printer head 1, with the sectional view being formed by cutting a plane at a base-side partition of the ink chamber in a direction perpendicular to the illustration shown in FIG. 8. In the printer head 1, when a stepped portion of a size of the order of 1 (m is produced by the wiring pattern 9, a gap is correspondingly produced between the dry film 13 and the orifice plate 14. The gap may cause ink to leak from the partition of the ink chamber. In particular, as shown in FIG. 9A, at an endmost ink chamber 16A of a heater 8, the wiring pattern 9 is not disposed at all at the partition of the ink chamber beside it, so that the area of the gap becomes large, thereby causing the ink leakage to become noticeable at this portion. The structure shown in FIGS. 9A and 9B is a type in which ink is supplied from an edge of the semiconductor substrate. In FIGS. 9A and 9B, the lamination materials other than the second-layer wiring pattern 9 are not shown, and the external shape of the dry film 13 is shown by dotted lines in FIG 9A

SUMMARY OF THE INVENTION

In view of the above-described points, it is an object of the present invention to provide a printer in which an orifice plate can be bonded by bringing it sufficiently into close contact with what it is to be bonded to, a printer head, and a method of producing the printer head.

To overcome such problems, the present invention is applied to the printer, the printer head, or the method of producing the printer head, and, by disposing a wiring pattern below a partition of an ink chamber, a thickness-direction stepped portion is prevented from being formed at least at the partition of the ink chamber.

According to the structure of the present invention, by preventing a thickness-direction stepped portion from being formed at least at the partition of the ink chamber by disposing a wiring pattern below the partition of the ink chamber, it is possible to, by using a simple structure, prevent formation of a gap between a material forming the partition of the ink chamber and a plate-shaped material, which is an orifice plate, disposed above the material forming the partition of the ink chamber. This makes it possible to prevent ink leakage, so that the orifice plate can be bonded by bringing it sufficiently into close contact with what it is to be bonded to.

DESCRIPTION OF THE PREFERRED EMBODIMENTS

Hereunder, a description of embodiments of the present invention will be given in detail with reference to the drawings when necessary.

(1) Structure of the First Embodiment

Figure 2A:
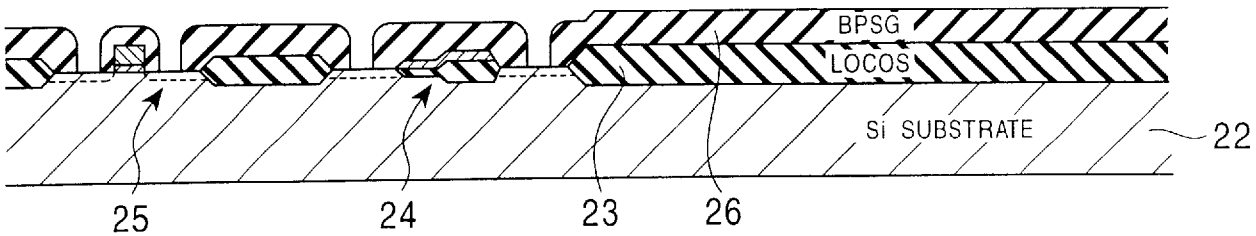
FIGS. 2A and 2B are sectional views illustrating steps of producing a printer head of an embodiment of the present invention.

FIGS. 2A to 4 are sectional views illustrating the steps of producing a printer head of an embodiment of the present invention. In the production process, as shown in FIG. 2A, after washing a P-type silicon substrate 22, silicon nitride films are deposited thereon. In the process, by lithography and reactive ion etching, the silicon substrate 22 is processed in order to remove the silicon nitride films deposited on areas other than predetermined areas where transistors are formed. By these operations, in the production process, silicon nitride films are formed in the areas on the silicon substrate 22 where the transistors are to be formed.

Then, in this process, by sputtering, titanium, titanium nitride barrier metal, and aluminum to which 0.5% of copper has been added are successively deposited to film thicknesses of 20 $\mu$m, 50 $\mu$m, and 600 $\mu$m. respectively. Thereafter, photolithography and dry etching are carried out to form a first-layer wiring pattern 28. In the process, by the first-layer wiring pattern 28, the MOS transistor 25, forming a drive circuit, is connected in order to form a logic integrated circuit.

Figure 2B:
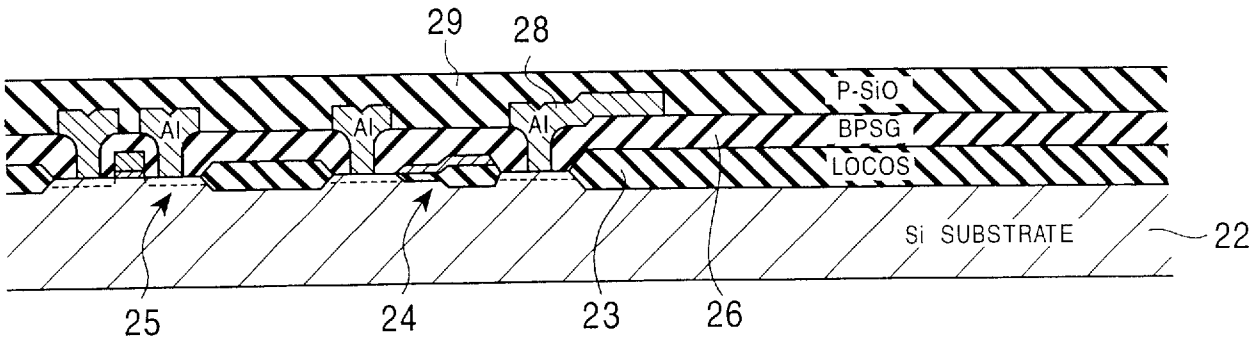

Next, in this process, as shown in FIG. 2B, by photolithography and reactive on etching using CFx gas, a connection hole (contact hole) is formed at a silicon semiconductor diffusion layer (source·drain).

Then, in this process, by sputtering, titanium, titanium nitride barrier metal, and aluminum to which 0.5 at % of copper has been added are successively deposited to film thicknesses of 20 $\mu$m, 50 $\mu$m, and 600 $\mu$m, respectively.

Thereafter, photolithography and dry etching are carried out to form a first-layer wiring pattern 28. In the process, by the first-layer wiring pattern 28, the MOS transistor 25, forming a drive circuit, is connected in order to form a logic integrated circuit.

Then, in the process, a silicon oxide film 29 (what is called TEOS), which is an interlayer insulating film, is deposited by CVD in order to, by CMP (chemical mechanical polishing) or resist etch back, smoothen the silicon oxide film 29.

Figure 3A:
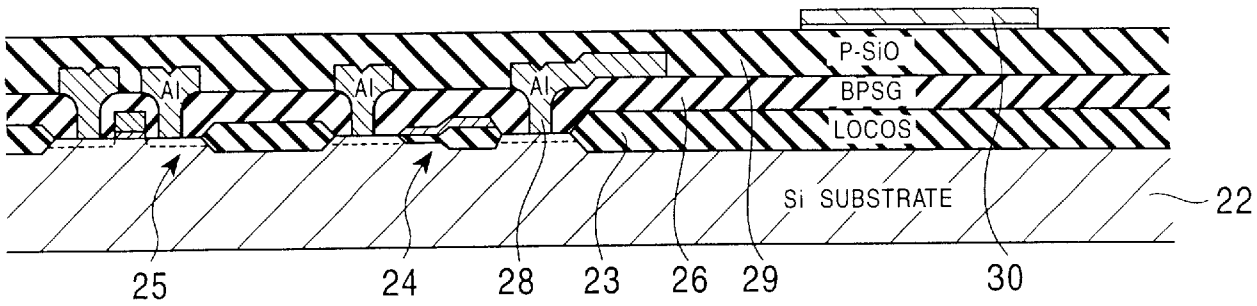
FIGS. 3A and 3B are sectional views illustrating steps following those illustrated in FIGS. 2A and 2B.

Next, in this process, as shown in FIG. 3A, by sputtering, a titanium film having a film thickness of 10 nm is deposited as a close contact layer. Then, titanium nitride or tantalum is deposited to a film thickness of 100 nm, so that resistance films are deposited on the semiconductor substrate 22. Thereafter, by photolithography and dry etching, excess titanium films, etc., are removed in order to form heating elements 30. Here, in the embodiment, the heating elements 30 are formed so as to have substantially square shapes.

Figure 3B:
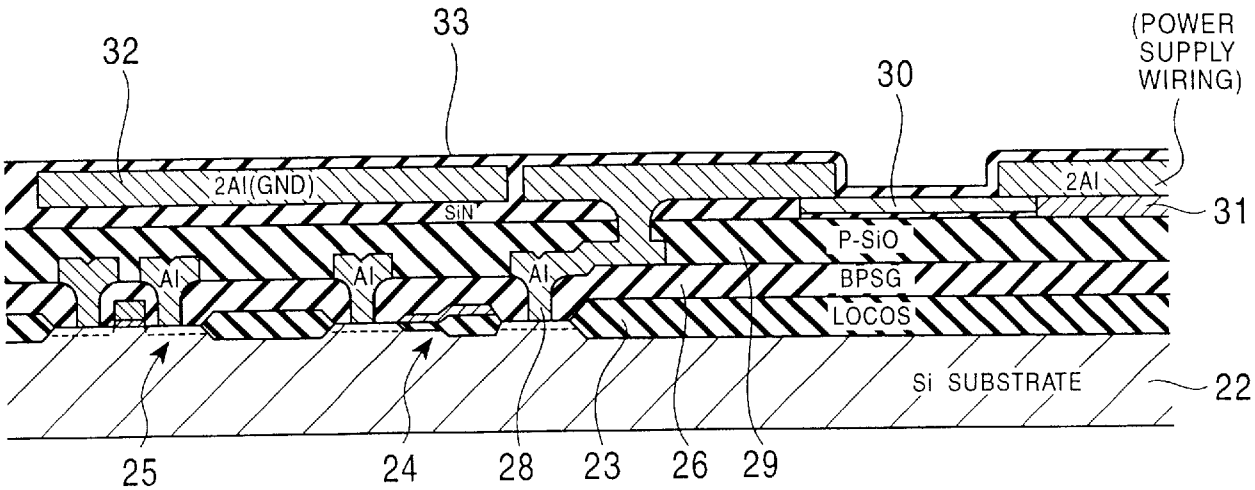

Next, in this process, as shown in FIG. 3B, a silicon nitride film 31 having a film thickness of 300 nm is deposited. Then, by photolithography and dry etching, a connection hole (via hole) following the formation of the first-layer wiring pattern 28 is formed. Thereafter, by sputtering, titanium, titanium nitride barrier metal, and aluminum to which 0.5% of copper has been added are successively deposited to film thicknesses of 20 (in, 50 (in, and 100 nm, respectively. Then, by photolithography and dry etching, second-layer wiring patterns 32 are formed. In this process, by the second-layer wiring patterns 32, power supply wiring patterns and ground wiring patterns are formed, and a wiring pattern for connecting the drive transistor 24 to the heating elements 30 is formed, so that a thickness-direction stepped portion is not formed at a partition of each ink chamber.

Figure 1:
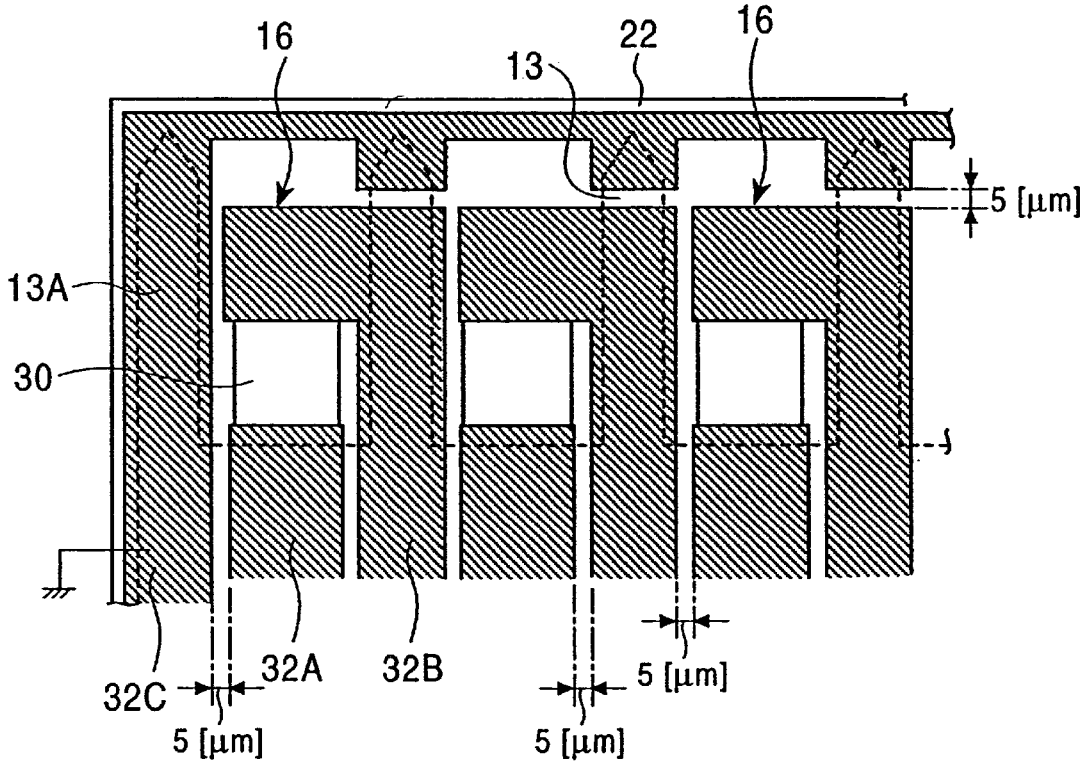
FIG. 1 is a plan view showing a layout of a wiring pattern used in a first embodiment of the present invention.
Figure 9A:
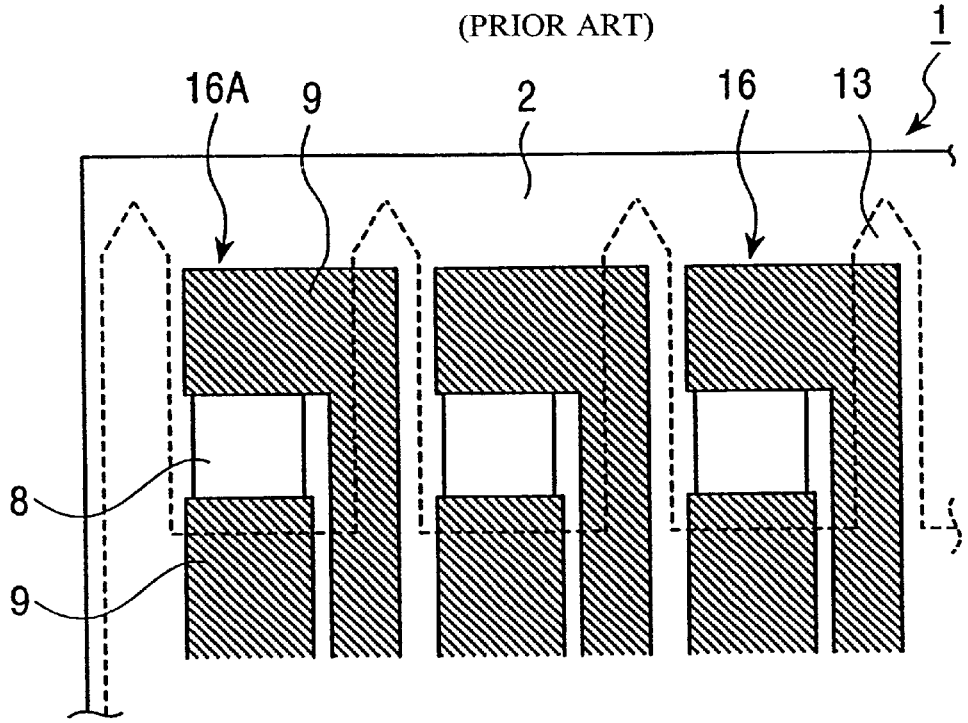
FIG. 9A (PRIOR ART)
FIGS. 9A and 9B are a plan view and a view showing a layout of a wiring pattern of the printer head shown in FIG. 8.
Figure 9B:
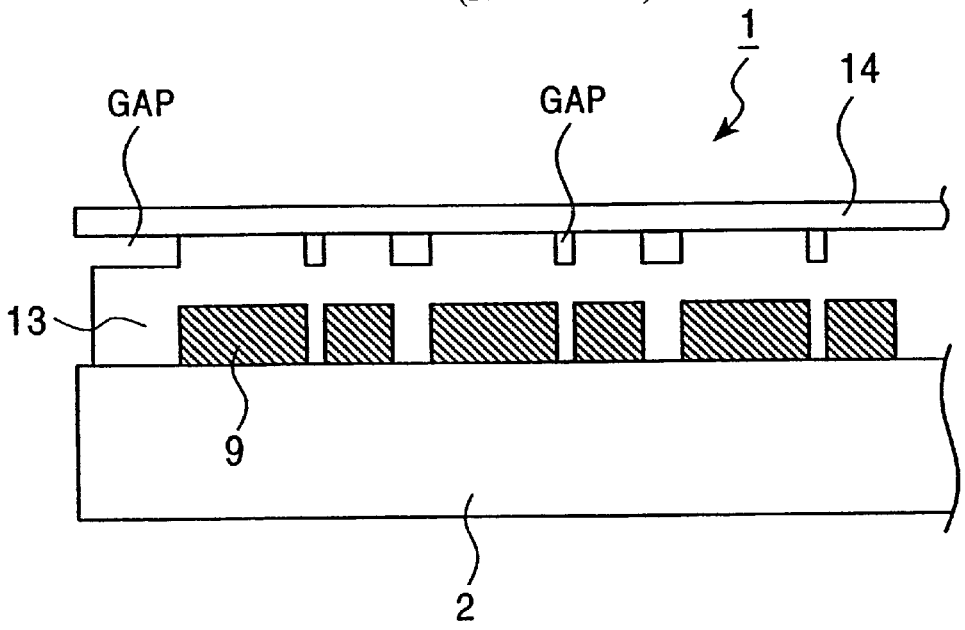
FIG. 9B (PRIOR ART)

More specifically, by contrast with FIG. 9, as shown in FIG. 1, in the embodiment, the printer head is constructed so that ink is supplied from an edge in a longitudinal direction. In the printer head, the partition of each ink chamber 16 is formed by a dry film 13 so as to be U-shaped in this plan view so that each ink chamber 16 opens to the ink-supply-side edge.

In the printer head, each wiring pattern 32A, which is connected to one end of its corresponding heating element 30, is disposed so that it crosses below the back partition of its corresponding ink chamber 16. Each wiring pattern 32B, which is connected to the other end of its corresponding heating element 30, is disposed so that it extends along the ink-supply-side edge and is bent and extends below its corresponding ink chamber partition wall that extends at this edge side, so as to be substantially parallel to its corresponding wiring pattern 32A substantially due to the width of its corresponding partition.

In the printer head, the pattern widths of the wiring patterns 32A are selected so that the distances between the pairs of wiring patterns 32A and 32B are approximately 5 $\mu$m at the portions where the pairs of wiring patterns 32A and 32B extend parallel to each other. Pattern widths are also selected so that adjacent ink chamber wiring patterns 32B are separated by about 5 $\mu$m so as to extend parallel to each other.

Accordingly, in the printer head, between adjacent ink chambers 16, the widths of the wiring patterns 32A and the wiring patterns 32B are selected so that the distances between the adjacent wiring patterns 32A and 32B become small, within a range which makes it possible to prevent accidents, such as short circuits. Therefore, it is possible prevent leakage of ink at the back side of each ink chamber 16. Consequently, as in the embodiment, when the wiring patterns 32A and 32B are separated by approximately 5 $\mu$m, a side surface of an orifice plate 14 at the dry film 13 can be formed into a substantially smooth surface, so that, at this portion, it is possible to prevent the leakage of ink.

In contrast, a partition 13A of the endmost ink chamber has a dummy wiring pattern 32C, which is not used in any way in driving the heating elements 30. Here, like the other wiring patterns 32A and 32B, the dummy wiring pattern 32C is separated by approximately 5 $\mu$m from the adjacent wiring pattern 32A, so that, by this separation, it extends below the corresponding ink chamber partition due to the width of the partition. Therefore, in the printer head 1, even at this end portion, it is possible to prevent the leakage of ink by preventing the formation of a stepped portion.

The dummy wiring pattern 32C is formed so that its front end side extends towards the ink-supply-side edge, is bent, and extends in the direction in which the heating elements 30 are disposed in a row. At the portion of the dummy wiring pattern 32C extending in the direction in which the heating elements 30 are arranged in a row, there arc portions that oppose their corresponding partitions. These portions arc formed so as to protrude towards their corresponding opposing wiring patterns 32B. The protruding portions of the dummy wiring pattern 32C are formed so as to be separated by 5 (in from the corresponding opposing wiring patterns 32B. Therefore, in the printer head, the front end side of the partition of each ink chamber 16 is formed so that it is possible to prevent leakage of ink even between adjacent ink chambers 16, thereby making it possible to prevent very small tilting of the orifice plate 14 towards the edge.

Next, in this process, as shown in FIG. 3B, by CVD, a silicon oxide film 33, which functions as an ink protective layer, is deposited.

Figure 4:
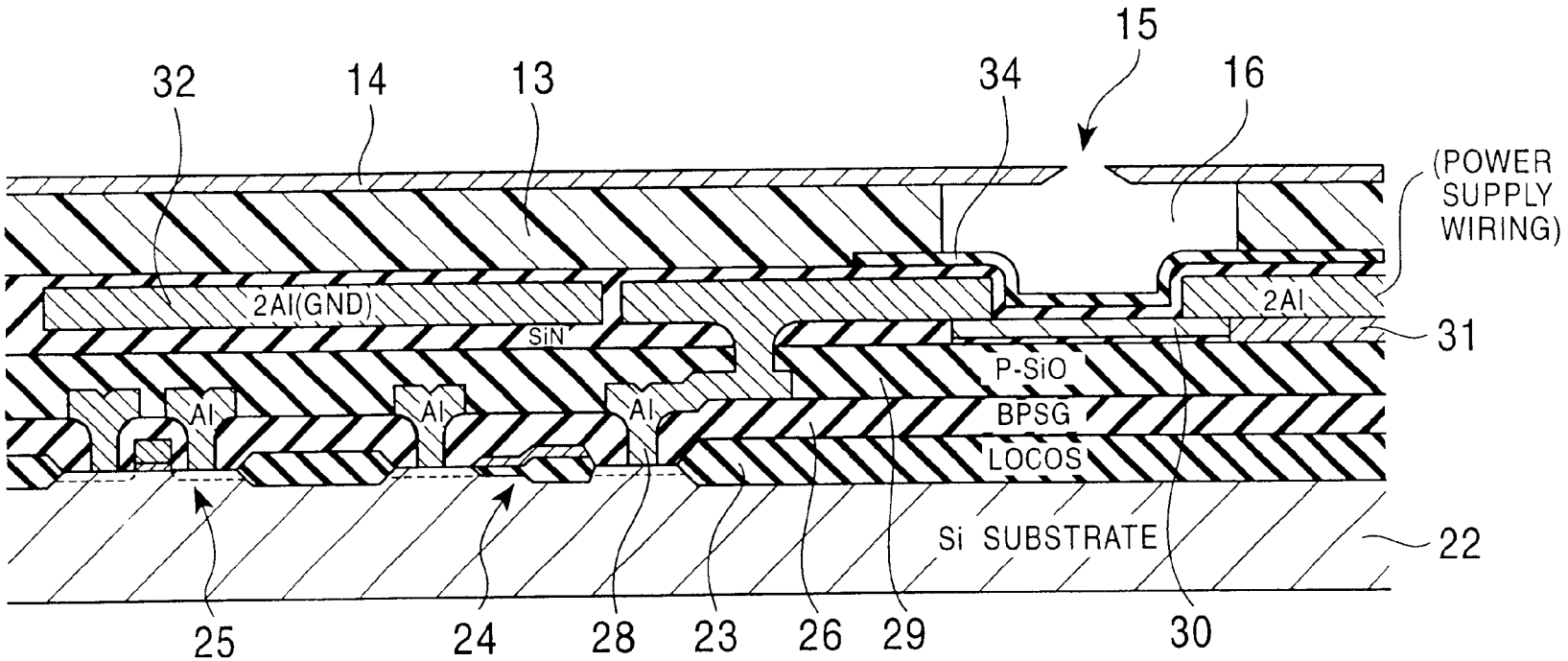
FIG. 4 is a sectional view illustrating steps following those illustrated in FIGS. 3A and 3B.

Then, as shown in FIG. 4, by sputtering, a tantalum film having a film thickness of 200 nm to 300 nm is deposited. By the tantalum film, a cavitation resistance layer 34 is formed. Then, the dry film 13 and the orifice plate 14 are successively deposited, and form the ink chambers 16, an ink path used to guide the ink to the ink chambers 16, and a nozzle 15. In this embodiment, photosensitive resin is used for the dry film 13. After placing it by contact bonding, an exposure operation is carried out to remove portions thereof in correspondence with the locations of the ink chambers and the ink path in order to form the dry film 13.

According to the above-described structure, by disposing the wiring patterns 32 below the partitions of the corresponding ink chambers 16, 50 that thickness-direction stepped portions are not formed at least at the partitions of the ink chambers 16, it is possible to bring the orifice plate 14 sufficiently into close contact with the dry film 13 rind to bond it thereto.

(2) Second Embodiment

Figure 5:
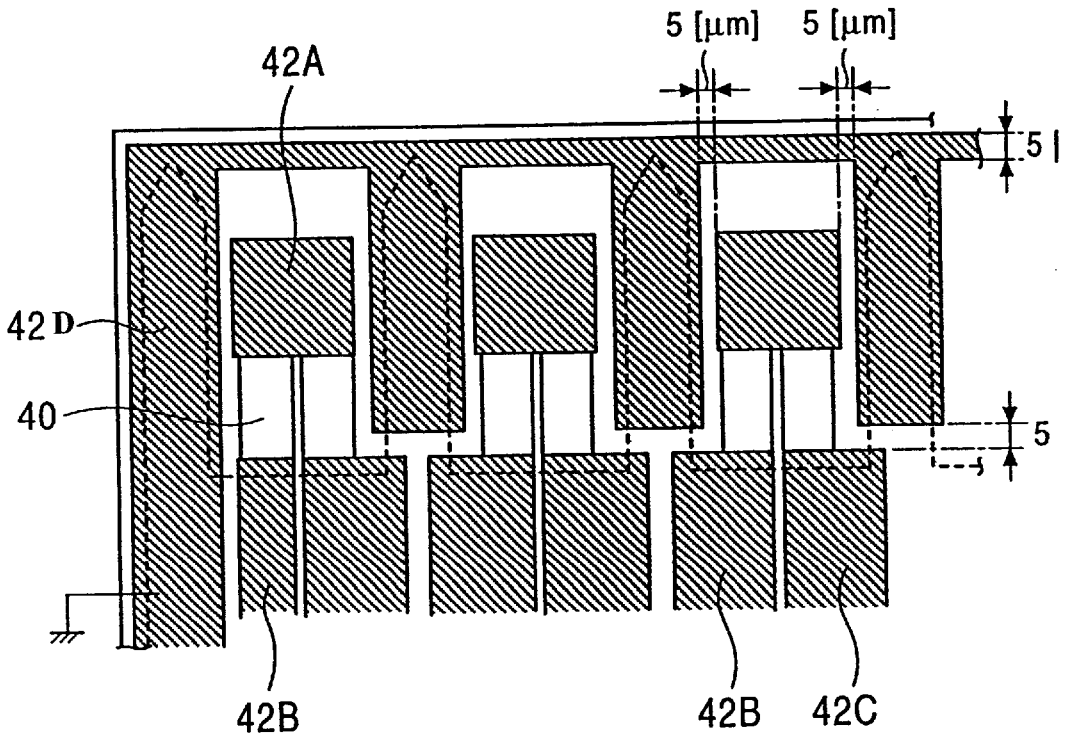
FIG. 5 is a plan view showing a layout of a wiring pattern used in a second embodiment of the present invention.

FIG. 5 is a plan view of the structures of second-layer wiring patterns and heating elements in a second embodiment of a printer head of the present invention, shown in contrast to those shown in FIG. 1. In the printer head of the embodiment, the second-layer wiring patterns and the heating elements are formed by the layout shown in FIG. 5 instead of the above-described layout shown in FIG. 1.

More specifically, with regard to each heating element 40, ends of two resistance patterns that extend substantially parallel to each other are connected by a corresponding second-layer wiring pattern 42A, so that a folded-back shape is formed. Then, both ends of each of the heating elements 40 having folded-up shapes are connected to the power supply line and the switching transistor, respectively, by corresponding second-layer wiring patterns 42B and 42C.

In the printer head, the wiring patterns 42B and the wiring patterns 42C are disposed sufficiently close to each other within a range not causing accidents, such as short circuits, and are disposed so as to cross below back partitions of the ink chambers. Therefore, also in the second embodiment, it possible to prevent the formation of stepped portions at the back sides of the ink chambers.

The end-side wiring pattern 42B of the endmost heating element 40 is formed with a small width, so that, as in the first embodiment, a dummy wiring pattern 42D is disposed correspondingly. Here, the wiring pattern 42D is formed so as to extend below the ink chamber partition at this end, and is disposed sufficiently close to the adjacent wiring pattern 42B within a range not causing accidents, such as short circuits. Therefore, it is possible to prevent the formation of a stepped portion at this end portion side.

The dummy wiring pattern 42D is formed so that an end portion is bent at an edge side and extends along the edge. The dummy wiring pattern 42D is formed so that portions thereof protrude towards the back sides of the corresponding ink chambers, at the partitions of the corresponding ink chambers. Ends of the protruding portions are such as to oppose the corresponding wiring patterns 42A and 42B at a distance of approximately 5 $\mu$m. Therefore, the printer head is such as to make it possible to prevent leakage of ink between adjacent ink chambers.

The dummy wiring pattern 42D is disposed in this way, and is connected to the ground lines of the second-layer wiring patterns. Therefore, in the printer head, it is possible to prevent various failures caused by disposing the dummy wiring pattern 42D, which is not used in any way in the driving of the heating elements 40, close to the wiring patterns 42A, 42B, and 42C.

As shown in FIG. 5, even when the heating elements 40 are constructed so as to be bent, it is possible to provide advantages similar to those of the first embodiment.

(3) Third Embodiment

Figure 6:
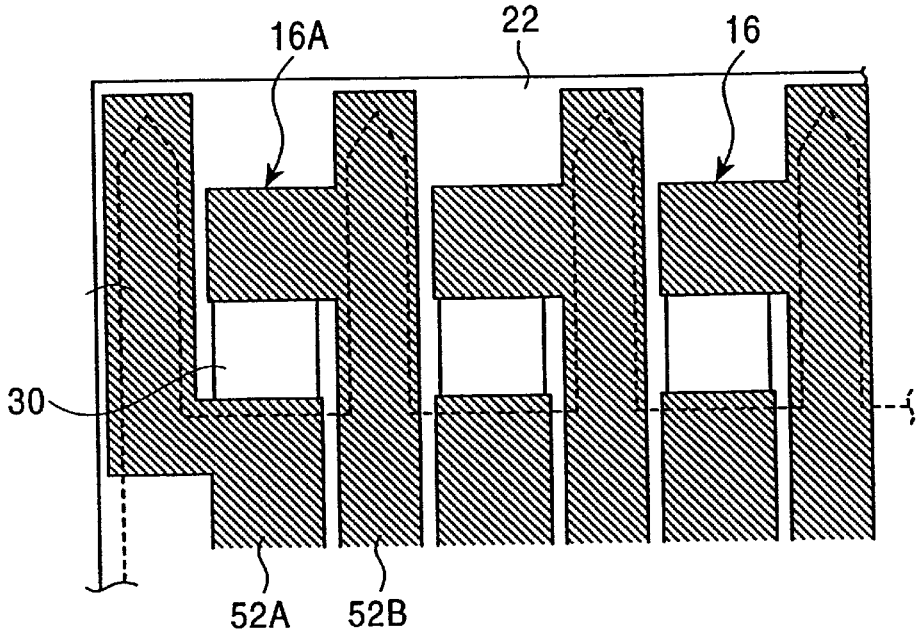
FIG. 6 is a plan view showing a layout of a wiring pattern used in a third embodiment of the present invention.

FIG. 6 is a plan view of the structures of second-layer wiring patterns and heating elements of a printer head of a third embodiment of the present invention, shown in contrast to those of FIG. 1. The printer head of the embodiment makes it possible to prevent leakage of liquid by preventing formation of a stepped portion as a result of extending wiring patterns 52A and 52B connected to heating elements 30.

More specifically, in the printer head, the wiring patterns 52B, which are connected to edge-side end portions of the corresponding heating elements 30, are formed so that edge-side portions thereof below ink chamber partitions protrude towards an edge side. This makes it possible to prevent formation of stepped portions between adjacent ink chambers, so that ink leakage can be prevented from occurring.

In contrast, with regard to the wiring pattern at the endmost side, a connecting portion thereof which connects to the corresponding element 30 extends towards an end portion side and is bent, so that the endmost side wiring pattern extends below the partition of the ink chamber at this end portion side to a edge side. Therefore, in the embodiment, at this end portion side also, it is possible to prevent leakage of ink by preventing formation of a stepped portion.

As shown in FIG. 6, when the wiring patterns, which are connected to the corresponding heating elements, are such as to extend below the ink chamber partitions, it is possible to obtain advantages similar to those of the first embodiment.

(4) Fourth Embodiment

Figure 7:
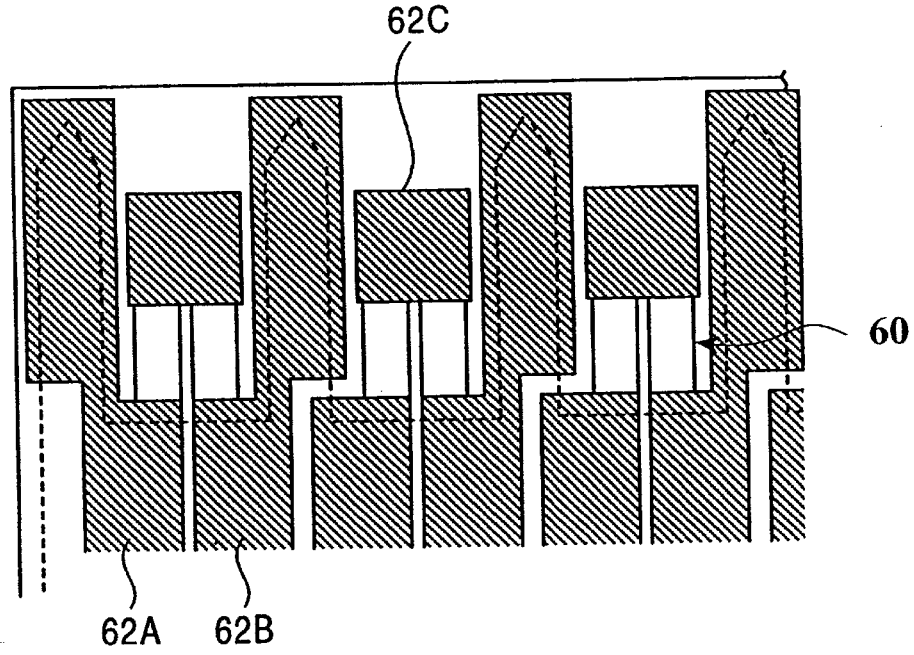
FIG. 7 is a plan view showing a layout of a wiring pattern used in a fourth embodiment of the present invention.
Figure 8:
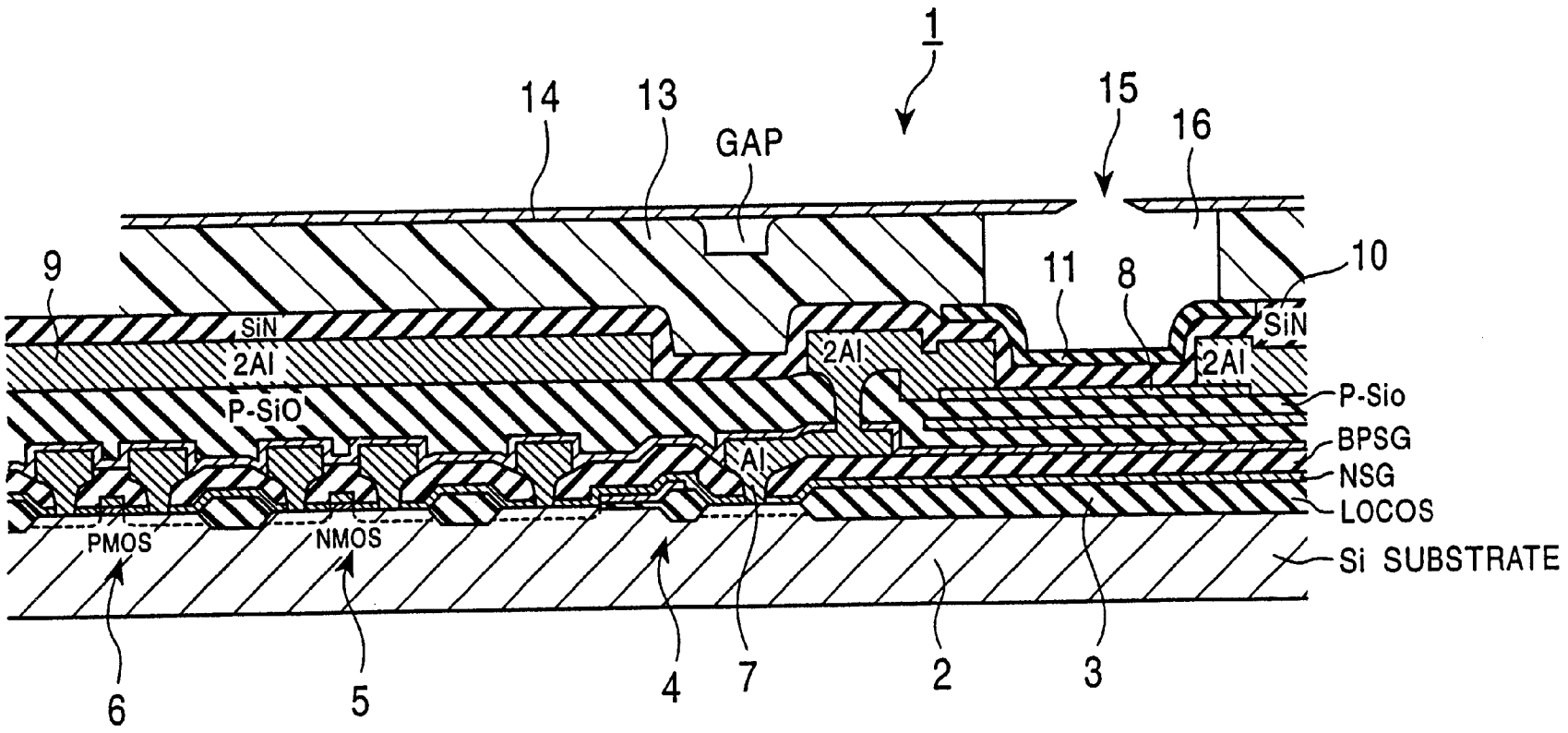
FIG. 8 (PRIOR ART)
FIG. 8 is a sectional view of a conventional printer head.

FIG. 7 is a plan view of the structures of second-layer wiring patterns and heating elements of a printer head of a fourth embodiment of the present invention, shown in contrast to those of FIG. 5. The printer head of the embodiment makes it possible to prevent leakage of liquid by preventing formation of stepped portions by extending wiring patterns 62A and 62B connected to heating elements 60. As shown in FIG. 7, and of the two patterns which extend substantially parallel to each other are connected by a corresponding second layer wiring patter 62C to form a folded-back shape.

More specifically, in the printer head, each wiring pattern 62B, connected to one end of its corresponding heating element 60, is formed so that a partition thereof disposed below its corresponding ink chamber partition is bent and extends below its corresponding ink chamber partition to an edge side. This makes it possible to prevent leakage of ink by preventing formation of stepped portions between adjacent ink chambers.

The endmost wiring pattern 62A is formed so that a connecting portion thereof that connects to the heating element 60 extends to an end portion side and is bent, so that the endmost wiring pattern 62A extends below the partition of the ink chamber at this end portion side to an edge side. Therefore, in this embodiment, at this end portion side also, it is possible to prevent leakage of ink by preventing formation of stepped portions. As shown in FIG. 7, in the case where the heating elements 60 are formed by bending, when the wiring patterns, which are connected to the corresponding heating elements 60, are made extend below the corresponding ink chamber partitions, it is possible to obtain advantages similar to those of the first embodiment.

(5) Other Forms

Although in the above-described embodiments the case where a structure having two layers of wiring patterns has been described, the present invention is not limited thereto, so that the present invention may be widely applied to, for example, a structure having one layer of wiring pattern or a structure having three of more layers of wiring patterns.

Although in the above-described embodiment the case where the heating elements are disposed on the bottom side of the wiring pattern at the topmost layer has been described, the present invention is not limited thereto, so that the present invention may be widely applied to, for example, the case where the heating elements are disposed at the top side of the wiring pattern at the topmost layer.

Although in the above-described embodiment the case where, for example, the heating elements are formed using tantalum films has been described, the present invention is not limited thereto, so various other types of lamination materials may be used when necessary.

What is claimed is:

1. A printer for performing a printing operation by causing ink drops to eject as a result of driving a heating element disposed in a printer head, wherein, predetermined lamination materials are in successive layers on a semiconductor substrate of a semiconductor device in order to form the heating element, a drive circuit which drives the heating element, an ink chamber which holds ink above the heating element, and an ink path used to guide ink to the ink chamber, a predetermined plate-shaped material forms the ink chamber, the ink path, and a nozzle, the nozzle is used to guide the ink in the ink chamber to the outside, and a non working wiring pattern disposed below the ink chamber which prevents step formation in the semiconductor substrate.

2. A printer according to claim 1, wherein the placement of the wiring pattern below the ink chamber is achieved by extending and forming the wiring pattern connected to the heating element.

3. A printer according to claim 1, further comprising multiple layers of wiring patterns, wherein the wiring pattern disposed below the ink chamber is the wiring pattern at a topmost layer.

4. A printer head used to perform a printing operation by causing ink drops to eject as a result of driving a heating element, wherein, predetermined lamination materials are in successive layers on a semiconductor substrate of a semiconductor device in order to form the heating element, a drive circuit which drives the heating element, an ink chamber which holds ink above the heating element, an ink path used to guide ink to the ink chamber, a predetermined plate-shaped material forms the ink chamber, the ink path, and a nozzle, the nozzle is used to guide the ink in the ink chamber to the outside, and a non working wiring pattern disposed below the ink chamber which prevents step formation in the semiconductor substrate.

5. A printer head according to claim 4, wherein the placement of the wiring pattern below the partition of the ink chamber is achieved by extending and forming the wiring pattern connected to the heating element.

6. A printer head according to claim 4, further comprising multiple layers of wiring patterns, wherein the wiring pattern disposed below the ink chamber is the wiring pattern at a topmost layer.

7. A method of producing a printer head used to perform a printing operation by causing ink drops to eject as a result of driving a heating element, the method comprising:

placing predetermined lamination materials successively upon each other on a semiconductor substrate of a semiconductor device in order to form the heating element, a drive circuit which drives the heating element, an ink chamber which holds ink above the heating element, and an ink path used to guide ink to the ink chamber;

placing a predetermined plate-shaped material which forms the ink chamber, the ink path, and a nozzle, the nozzle being used to guide ink in the ink chamber to the outside; and placing a non working wiring pattern below the ink chamber which prevents step formation within the semiconductor substrate.

8. A method of producing a printer head according to claim 7, wherein the step of placing the wiring pattern below the ink chamber is achieved by extending and forming the wiring pattern connected to the heating element.

9. A method of producing a printer head according to claim 7, further comprising the step of providing multiple layers of wiring patterns, wherein the wiring pattern disposed below the ink chamber is the wiring pattern at a topmost layer.

10. A printer head, comprising:

a substrate;

a heating element disposed above the substrate;

a first wiring pattern, a second wiring pattern and a dummy wiring pattern disposed above the substrate wherein the first wiring pattern and the second wiring pattern are connected to the heating element;

an ink chamber associated with the heating element, the ink chamber is positioned to hold ink above the heating element, the ink chamber being formed by at least one side and at least one end wherein the first wiring pattern and the second wiring pattern are disposed below the at least one end of the ink chamber to smooth the ink chamber;

a dry film disposed around the ink chamber; and an orifice plate disposed on top of the dry film wherein the orifice plate is planarly bonded to the dry film since the ink chamber is planarly smoothed by the first wiring pattern and the second wiring pattern.

11. A printer head according to claim 10, wherein the dummy pattern is unconnected to the heating element.

12. A printer head according to claim 10, wherein the dummy pattern connects to a ground of the second wiring pattern.

13. A printer head according to claim 10, wherein the dummy pattern is disposed below the at least one side of the ink chamber to smooth the at least one side.

14. A printer head according to claim 10, wherein the first wiring pattern and the second wiring pattern are separated by approximately 5 $\mu$m.

15. A method of manufacturing a printer head, comprising:

forming a substrate;

disposing a heating element above the substrate;

disposing an ink chamber above the heating element wherein the ink chamber holds ink, the ink chamber being formed by at least one side and at least one end;

smoothing the ink chamber by disposing a first wiring pattern and a second wiring pattern below the at least one end of the ink chamber;

disposing a dry film on top of the heating element; and planarly bonding an orifice plate to the dry film.

16. The method according to claim 15, further comprising disposing a dummy pattern below the at least one side of the ink chamber.

17. The method according to claim 16, further comprising grounding the dummy pattern.

* * * * *